US006130371A

United States Patent [19]

Inoue

[11] Patent Number: 6,130,371

[45] Date of Patent: Oct. 10, 2000

[54] FALL BOARD STRUCTURE FOR KEYBOARD INSTRUMENT

[75] Inventor: Yasushi Inoue, Hamamatsu, Japan

[73] Assignee: Yamaha Corporation, Hamamatsu, Japan

[21] Appl. No.: 09/211,721

[22] Filed: Dec. 14, 1998

[30] Foreign Application Priority Data

Dec. 15, 1997 [JP] Japan ..... 9-362483

[51] Int. Cl.[7] ..... G10C 3/02

[52] U.S. Cl. ..... 84/179

[58] Field of Search ..... 84/179

[56] References Cited

U.S. PATENT DOCUMENTS

| | | | |
|---|---|---|---|
| 4,817,487 | 4/1989 | Yamashita . | |
| 5,056,396 | 10/1991 | Furakawa . | |
| 5,152,189 | 10/1992 | Miura et al. . | |
| 5,635,655 | 6/1997 | Yamashita . | |
| 5,920,019 | 7/1999 | Inoue | 84/179 |

FOREIGN PATENT DOCUMENTS

| | | | |
|---|---|---|---|
| 1137294 | 5/1989 | Japan | G10C 3/00 |

*Primary Examiner*—Robert E. Nappi
*Assistant Examiner*—Shih-Yung Hsieh
*Attorney, Agent, or Firm*—Pillsbury Madison & Sutro LLP

[57] ABSTRACT

A fall board structure is provided for a keyboard instrument having a keyboard, in which a plurality of keys are arranged between side arms, to actualize light, comfortable and safe operations of a fall board. The fall board structure is basically constructed by arms, torque shaft units and rotation members. Herein, the arm is fixed to a side end of the fall board, so that it rotates in response to rotary movement of the fall board, while the torque shaft unit is fixed to the side arm of the keyboard, wherein it has a shaft portion which rotates in accordance with the rotary movement of the fall board. The rotation member is constructed by a clutch portion and a in lever portion, which is brought into contact with a lower edge portion of the arm at a contact point. The shaft portion of the torque shaft unit engages with the clutch portion of the rotation member equipped with a one-way clutch mechanism such that the clutch portion locks the shaft portion when the shaft portion rotates in a counterclockwise direction corresponding to a close operation direction of the fall board while the clutch portion releases the shaft portion when the shaft portion rotates in a clockwise direction corresponding to an open operation direction of the fall board. Thus, only in a close operation mode of the fall board, the torque shaft unit produces resistance force, which is transmitted to the arm via the contact point.

14 Claims, 11 Drawing Sheets

FALL BOARD STRUCTURE FOR KEYBOARD INSTRUMENT

BACKGROUND OF THE INVENTION

1. Field of the Invention

This invention relates to fall board structures for keyboard instruments such as musical instruments having keyboards.

This application is based on Patent Application No. Hei 9-362483 filed in Japan, the content of which is incorporated herein by reference.

2. Description of the Related Art

According to the conventional fall board structure (or cover structure) employed in musical instruments such as keyboard instruments, an oil damper is used to provide resistance in a cover-close mode to close the fall board (or cover) of the keyboard instrument. In this structure, a valve member and orifice are provided inside of a damper mechanism to increase or decrease a flow (or discharge) of oil for controlling damper force. At a cover-open mode, the valve member opens to increase the flow of oil so that the fall board smoothly opens. At a cover-close mode, the valve member closes to let the oil flow through the orifice. So, the flow of oil is decreased such that the damper force is strengthened. Thus, it is possible to provide strong resistance of the damper only at the cover-close mode. In contrast, it is possible to almost cancel the resistance at the cover-open mode.

In addition, an open/close device uses a torque shaft bush to impart resistance to an open/close member (e.g., cover) at cover-open/close modes, which is disclosed by the paper of Japanese Patent Application, Publication No. Hei 1-137294, for example. According the structure of the open/close device, there are provided two friction mechanisms. One friction mechanism imparts frictional resistance to the open/close member with respect to an overall angle range in rotation (or rotary movement) of the open/close member. Another frictional mechanism imparts frictional force to the open/close member with respect to a specific angle range in rotation of the open/close member, for example, with respect to an intermediate angle range in open/close strokes. Thus, it is possible to avoid rapid open/close movements of the open/close member.

The conventional fall board structure of the musical instrument using the oil damper suffers from a problem due to a risk that occurs in response to a manner to close the fall board. Suppose an event that a user (i.e., a human operator of the musical instrument) performs a cover-close operation just after a cover-open operation. In that event, the valve member is initially placed in an open state, while in a transition from the open state to a close state of the valve member, it is impossible to obtain damper force. For this reason, resistance force does not occur immediately in response to the cover-close operation. Such a phenomenon is expressed by "play" or "hysteresis". This phenomenon causes problems in the case where after the fall board is fully closed, the user slightly lifts up and then releases the fall board, or in the case where the user misses his or her hand to slip the fall board. In those cases, occurrence of the resistance force delays so that the fall board speedily closes by its own weight. Thus, there is a problem that if a hand (or hands) of the user or another person is placed between a base rod portion of the keyboard and the fall board, the hand(s) may be strongly sandwiched between them.

As for the overall process of the cover-open operation and cover-close operation, response or follow-up performance of the resistance force is not so good due to existence of a relatively large "play" of the conventional fall board structure, which lacks comfortableness in operation.

The conventional fall board structure of the musical instrument using the torque shaft bush have a certain degree of freedom in operations because it is capable of imparting "strong" resistance force to the fall board with respect to the specific open/close angle range of the fall board. In addition, it does not have the foregoing problem due to the "play" so much. However, the above fall board structure requires complicated construction using two friction mechanisms, which is a troublesome.

SUMMARY OF THE INVENTION

It is an object of the invention to provide a fall board structure of a keyboard instrument that is capable of performing open/close operations of a fall board in a stable manner and comfortable manner with a simple construction.

A fall board structure of this invention is provided for a keyboard instrument having a keyboard, in which a plurality of keys are arranged between side arms, to actualize light, comfortable and safe operations of a fall board. The fall board structure is basically constructed by arms, torque shaft units and rotation members. Herein, the arm is fixed to a side end of the fall board, so that it rotates in response to rotary movement of the fall board, while the torque shaft unit is fixed to the side arm of the keyboard, wherein it has a shaft portion which rotates in accordance with the rotary movement of the fall board. The rotation member, which is normally pressed in a clockwise direction, is constructed by a clutch portion and a lever portion, which is brought into contact with a lower edge portion of the arm at a contact point. The shaft portion of the torque shaft unit engages with the clutch portion of the rotation member equipped with a one-way clutch mechanism such that the clutch portion locks the shaft portion when the shaft portion rotates in a counterclockwise direction corresponding to a close operation direction of the fall board while the clutch portion releases the shaft portion when the shaft portion rotates in a clockwise direction corresponding to an open operation direction of the fall board. Thus, only in a close operation mode of the fall board, the torque shaft unit produces resistance force, which is transmitted to the arm via the contact point.

The invention is designed to increase an increase ratio of a rotation angle of the rotation member against a rotation angle of the arm as the arm rotates deeply in the close operation direction. So, it is possible to gradually increase the resistance force applied to the fall board which rotates in the close operation direction. Thus, the user is capable of performing the close operation of the fall board in a safe manner.

In contrast, when the fall board rotates in the open operation direction, the torque shaft unit does not produce the resistance force. Thus, the user is capable of performing the open operation; of the fill board with light force.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

[A] Embodiment 1

Figure 1:
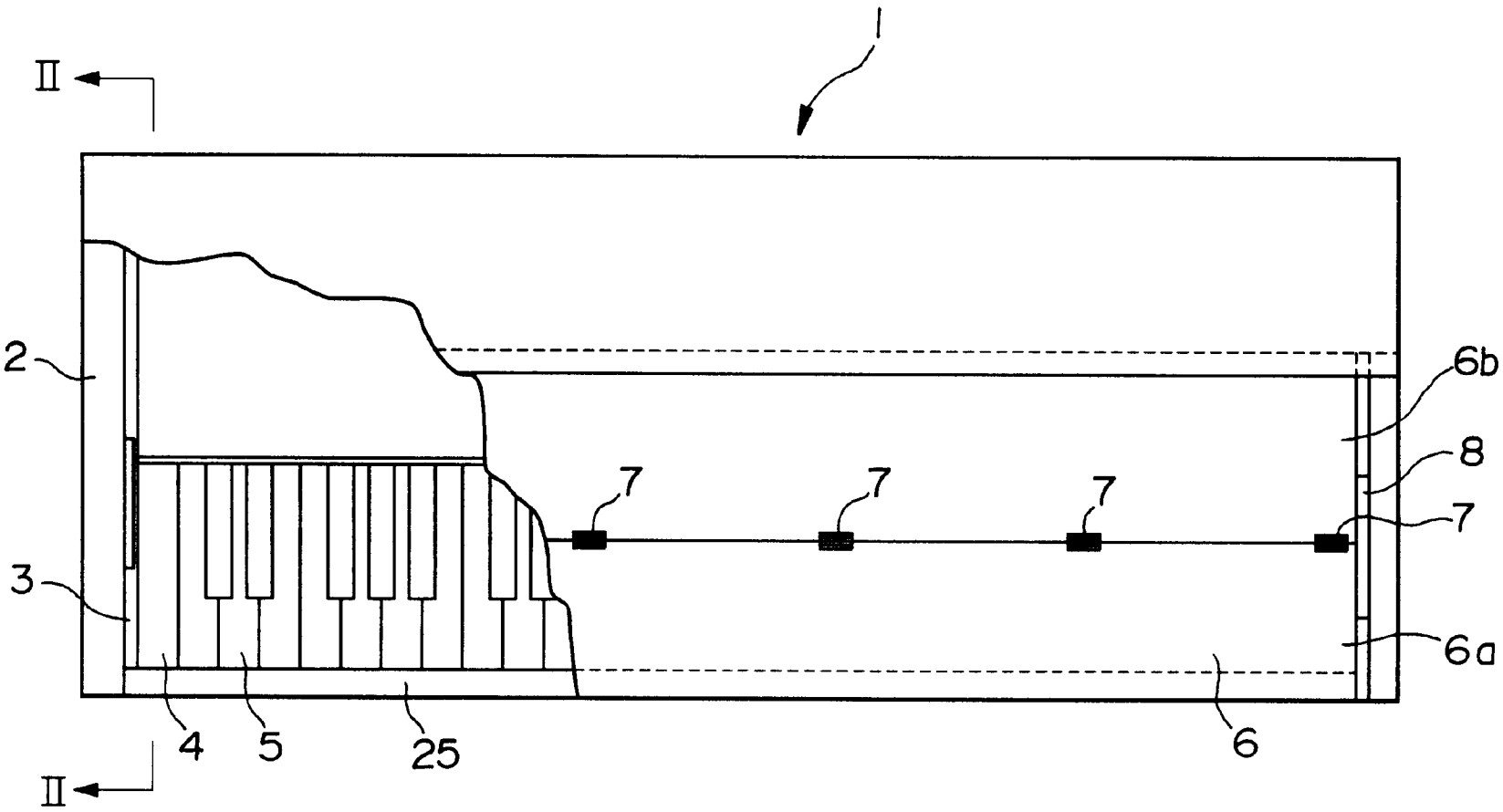
FIG. 1 is a plan view showing an appearance of a keyboard unit of a musical instrument which has a fall board structure in accordance with embodiment 1 of the invention.

FIG. 1 is a plan view showing an appearance of a main body (or keyboard unit) of a musical instrument which has a fall board structure in accordance with embodiment 1 of the invention.

Both of side ends of a keyboard unit 1 are defined by side arms 2 made of wood materials. In an inside area between the side arms 2, angle plates 3 and wood members 4 are sequentially arranged. In addition, keys 5 are arranged in such a way that each key is placed between left and right wood members 4. The fall board 6 is constructed by a fall board front 6*a* and a fall board rear 6*b*. In addition, arms 8 are attached to side ends of the fall board 6.

Figure 2:
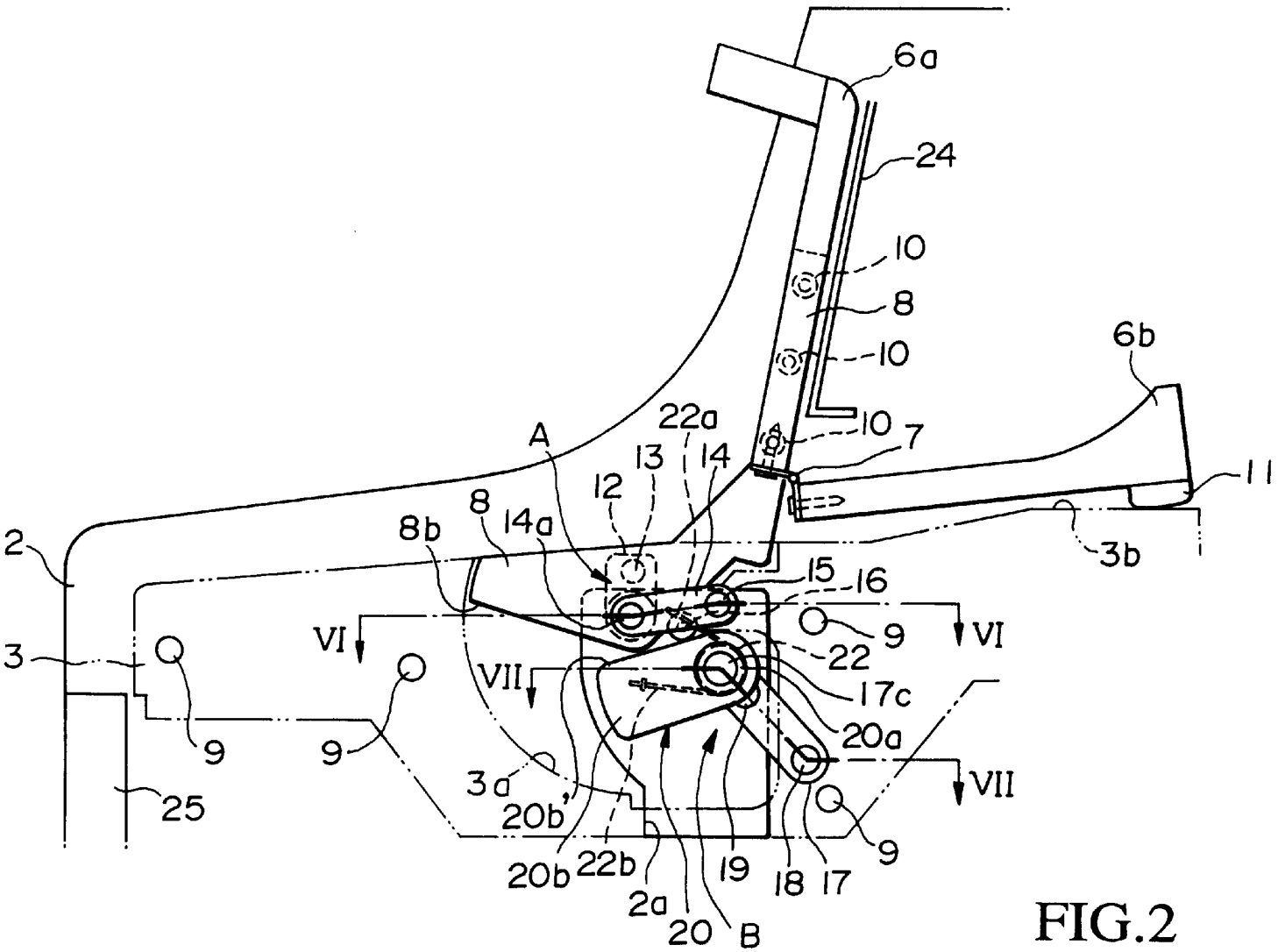
FIG. 2 is a sectional view showing a cross section of the keyboard unit take on line II—II in FIG. 1 with regard to a full-open state of a fall board.
Figure 3:
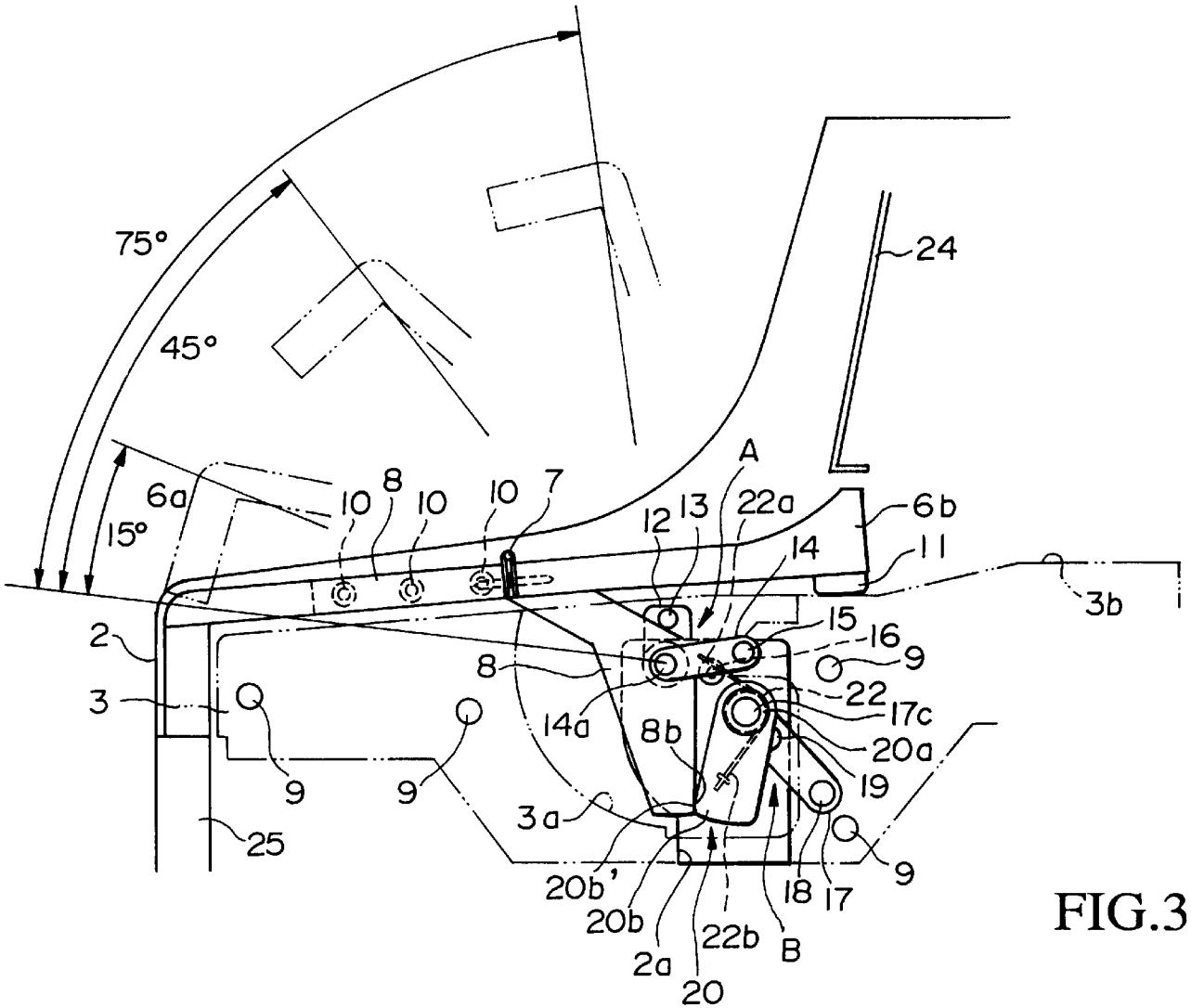
FIG. 3 is a sectional view showing a cross section of the keyboard unit taken on line II—II in FIG. 1 with regard to a full-close state of the fall board.

FIG. 2 and FIG. 3 show cross sections of the keyboard unit 1 taken on line II—II in FIG. 1. For convenience's sake, illustration of the wood member 4 is omitted while the angle plate 3 is shown by a dashed line. Specifically, FIG. 2 shows a full-open state of the fall board 6 while FIG. 3 shows a full-close state of the fall board 6.

In FIG. 2, an angle plate 3 is fixed to an interior wall of the side arm 2 by screws 9. The fall board 6 is constructed such that the fall board front 6*a* is interconnected with the fall board rear 6*b* by hinges 7 in a free rotation manner. Arms 8 are attached to side ends of the fall board front 6*a* by screws 10. A slide member 11 is securely adhered to a lower surface of a backend portion of the fall board rear 6*b*. At open/close modes of the fall board 6, the slide member 11 slides on an upper end surface 3*b* of the angle plate 3.

Due to operation of a rotation mechanism A which will be described later, the arm 8 rotates about an arm rotation shaft 14*a* of a shaft unit 14. Accompanied with rotation of the arm 8, the fall board front 6*a* of the fall board 6 rotates so that the fall board 6 is opened or closed. In addition, the fall board rear 6*b* slides along an upper surface of the angle plate 3 in a backward direction in response to rotation of the fall board front 6*a* in its open direction. Or, the fall board rear 6*b* slides along the upper surface of the angle plate 3 in a forward direction in response to rotation of the fall board front 6*a* in its close direction. A full-open position of the fall board 6 is defined by a stopper 24 (see FIG. 2), while a full-close position is defined by a base rod portion 25 (see FIG. 3).

At a close operation mode of the fall board 6, a torque mechanism B, which will be described later, imparts resistance force to the fall board 6 so that the fall board 6 will be closed with appropriate weight.

Next, constructions of the rotation mechanism A and the torque mechanism B will be described in detail with reference to FIG. 4 to FIG. 8 as well as FIG. 2 and FIG. 3.

Figure 4:
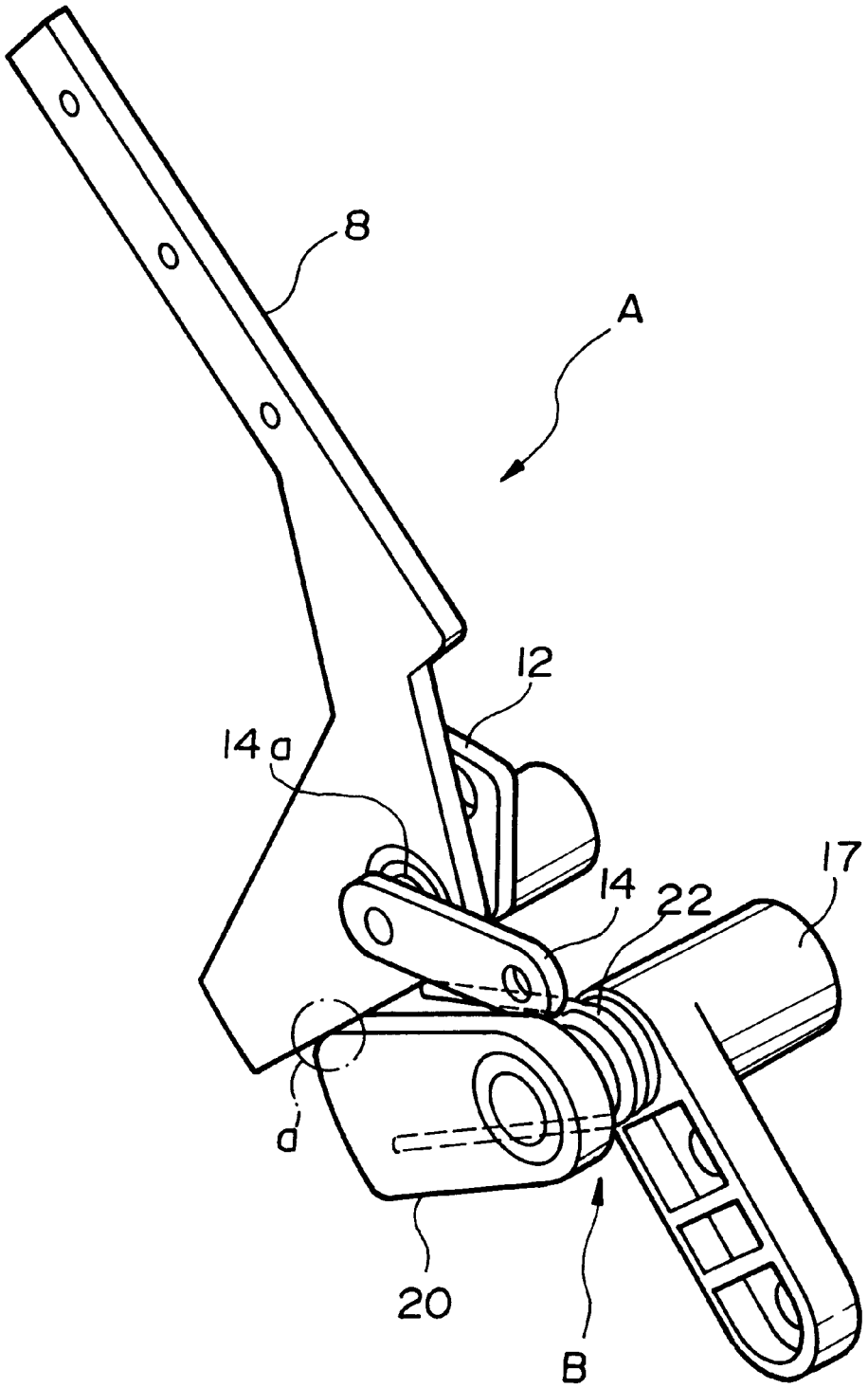
FIG. 4 is a perspective view showing an open/close mechanism of the fall board structure which is assembled.
Figure 5:
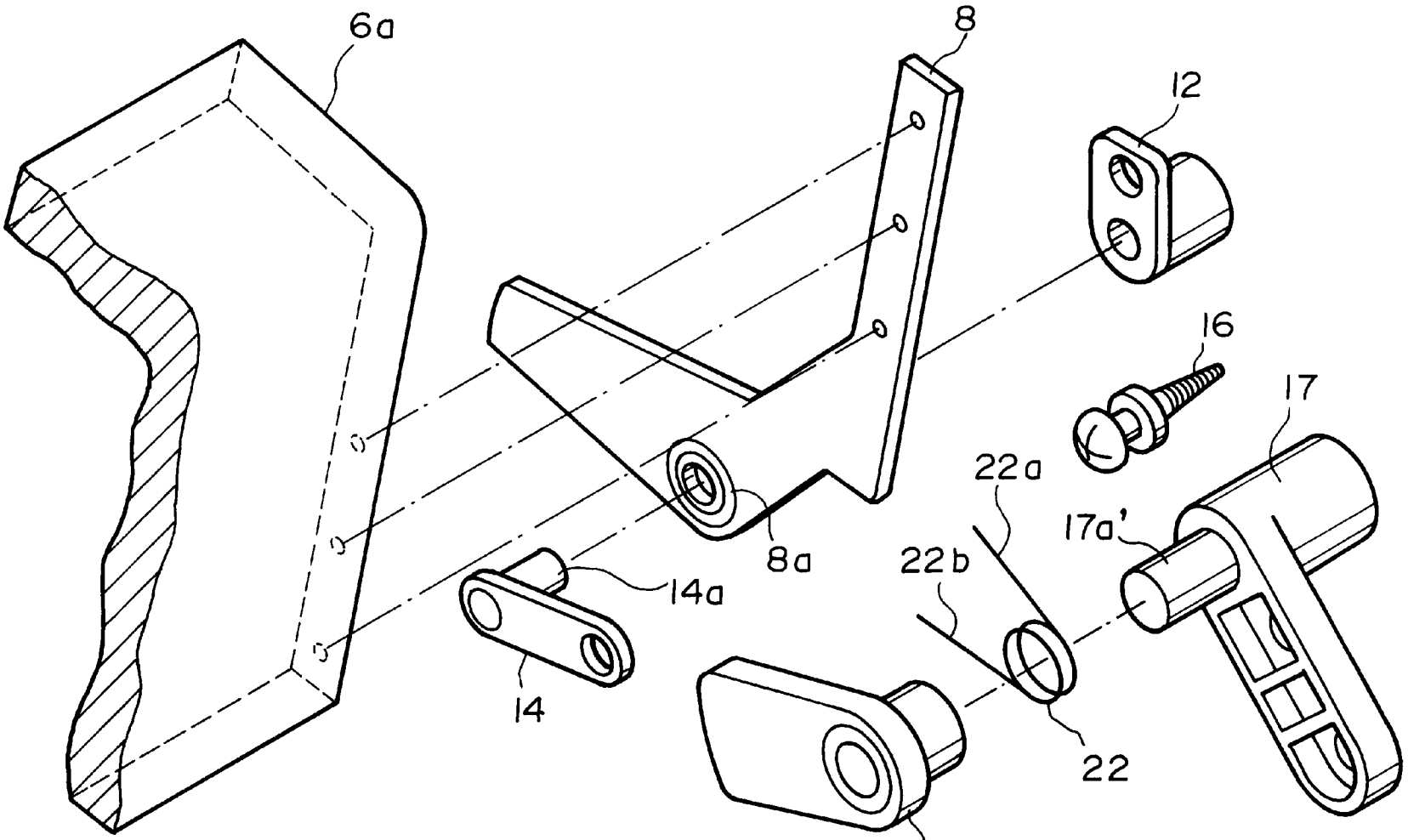
FIG. 5 is an exploded view in perspective of parts which are, assembled together to construct the open/close mechanism.

FIG. 4 is a perspective view of an open/close mechanism of the fall board structure of the present embodiment. FIG. 5 is an exploded view in perspective of the open/close mechanism. All of parts shown in FIG. 4 and FIG. 5 are concerned with a left portion of the keyboard unit 1 shown in FIG. 1. So, parts used for a right portion of the keyboard unit are constructed symmetrically as compared with the parts of the left portion of the keyboard unit. As shown in FIG. 4, the open/close mechanism of the fall board structure is mainly constructed by the rotation mechanism A and the torque mechanism B. Herein, the rotation mechanism A is constructed by the arm 8, a guide member 12 and a shaft unit 14, while the torque mechanism B is constructed by a stopper screw 16 (see FIG. 5), a torque shaft unit 17, a rotation member 20 and a spring 22.

In the shaft unit 14 of the rotation mechanism A, an arm rotation shaft 14*a* penetrates through a hole 8*a* (see FIG. 5) of the arm 8, so that it is assembled to the guide member 12. Thus, the arm 8 is placed in a free rotation manner that it is capable of freely rotating about the arm rotation shaft 14*a* of the shaft unit 14.

In the torque mechanism B, the rotation member 20 is assembled to the torque shaft unit 17, which is fixed to the foregoing side arm 2, by intervention of the spring 22. Thus, the rotation member 20 is placed to have a capability of rotation that it rotates about a torque shaft end 17*a*' of the torque shaft unit 17. Herein, the torque shaft unit 17 is constructed as a so-called torque shaft bush. So, when the torque shaft end 17*a*' is forced to rotate, the torque shaft unit 17 produces resistance force (i.e., torque) against rotation of the torque shaft end 17*a*'. In addition, the rotation member 20 is equipped with a one-way clutch mechanism, details of which will be described later. So, when the rotation member 20 rotates in a counterclockwise direction in FIG. 4, it strongly locks the torque shaft end 17*a*'. In contrast, when the rotation member 20 rotates in a clockwise direction, it releases the lock thereof to release the torque shaft end 17*a*'. Therefore, only in the case of the rotation of the counterclockwise direction, the rotation member 20 is placed under the resistance force due to the torque shaft unit 17. The stopper screw 16 is fixed to the side arm 2 as a stopper for the rotation member 20 and the spring 22. The spring 22 engages with the rotation member 20. In addition, it also engages with the stopper screw 16 to normally force the rotation member 20 to rotate in the clockwise direction.

The rotation mechanism A and the torque mechanism B are, arranged in such a way that in a close operation process of the fall board front 6*a* of the fall board 6, the arm 8 is placed in contact with the rotation member 20 at a contact point "a". Accompanied with the close operation of the fall board front 6*a*, the rotation member 20 rotates in the counterclockwise direction in FIG. 4. Thus, it is possible to impart resistance force to the close operation of the fall board 6. In contrast, no resistance force is applied to the open operation of the fall board 6. At the open operation mode of the fall board 6, the spring 22 works to maintain engagement between the arm 8 and the rotation member 20.

Figure 6:
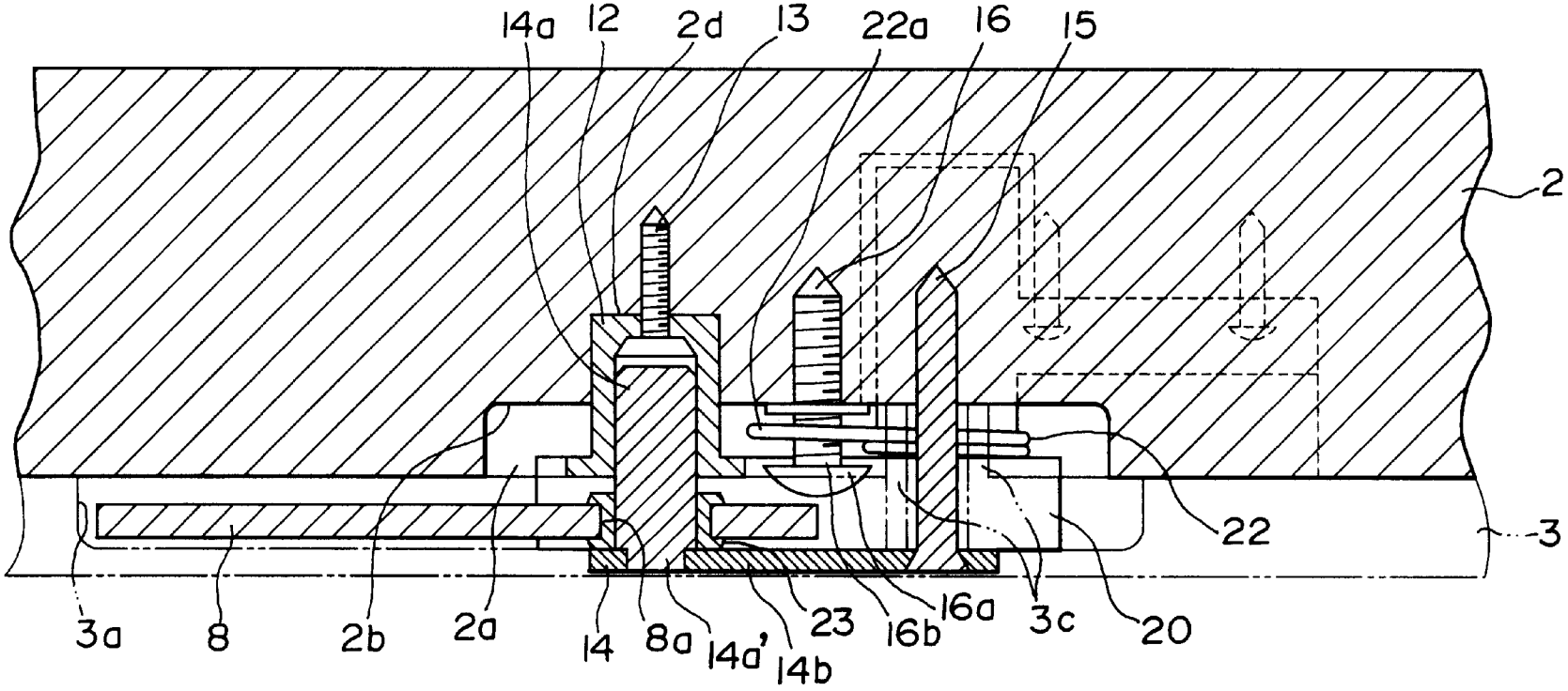
FIG. 6 is a sectional view, taken on line VI—VI in FIG. 2, showing a construction of a rotation mechanism of an arm of the fall board structure.

FIG. 6 shows a construction of the rotation mechanism A of the arm 8 of the fall board structure of the present embodiment. In other words, FIG. 6 is a sectional view taken on line VI—VI in FIG. 2.

A recess 2*a* is formed on an interior wall of the side arm 2. The recess 2*a* has a first bottom surface 2*b*, a part of which is dug in to form a hole 2*d*. The foregoing guide member 12 is fixed into the hole 2*d* by a screw 13. A cutout portion 3*a* is formed at a selected part of the angle plate 3 to secure space allowing rotation of the arm 8. In addition, spacer members 3*c* are formed as integral parts of the angle plate 3 to fix the shaft unit 14. The spacer members 3*c* are brought into contact with the first bottom surface 2*b* of the recess 2*a* of the side arm 2.

The shaft unit 14 is attached to the side arm 2 and the angle plate a. Herein, the shaft unit 14 is constructed by a arm rotation shaft 14*a* and a flat plate portion 14*b*. A shaft end 14*a*' of the arm rotation shaft 14*a* engages with a hole which is formed at one end of the flat plate portion 14*b*. Thus, the shaft unit 14 is securely fixed to the angle plate 3 by spot wed and the like. The shaft unit 14 is subjected to engagement with the guide member 12 such that the arm rotation shaft 14*a* penetrates through the hole 8*a* of the arm 8. In addition, another end of the flat plate portion 14*b* of the shaft unit 14 is fixed with the first bottom surface 2*b* of the recess 2*a* of the side arm 2 via the spacer members 3*c* of the angle plate 3 by means of a screw 15.

Specifically speaking, a "circular" slide member 23 is adhered to an inner periphery of the hole 8*a* of the arm 8, while the arm rotation shaft 14*a* of the shaft unit 14 penetrates through interior space of the slide member 23. Thus, the arm 8 is capable of freely rotating about the arm rotation shaft 14*a*. At rotation of the arm 8, the slide member 23 slides with the arm rotation shaft 14*a*. Thus, it is possible to secure "smooth" rotation of the arm 8.

A stopper screw 16 is penetrated on the first bottom surface 2*b* of the recess 2*a* of the side arm 2. A first end 22*a* of the spring 22 is normally brought into contact with a neck portion 16*b* of the stopper screw 16. Thus, the first end 22*a* of the spring 22 is terminated by the neck portion 16*b* of the stopper screw 16. In addition, a head portion 16*a* of the stopper screw 16 comes in contact with the rotation member 20, so that the stopper screw 16 regulates a rotation position (or initial position) of the rotation member 20 approximately at a full open mode of the fall board 6.

Figure 7:
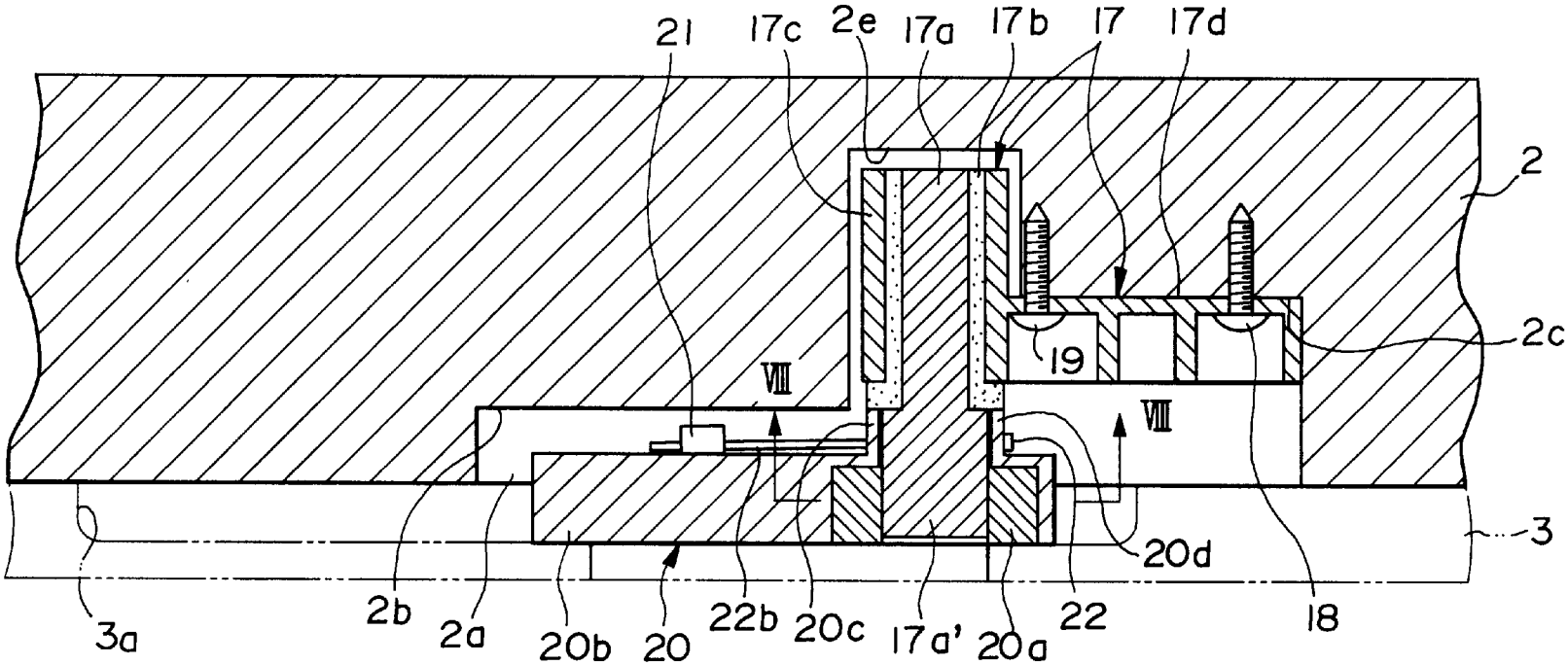
FIG. 7 is a sectional view, taken on line VII—VII in FIG. 2, showing a construction of a torque mechanism.

FIG. 7 shows a construction of the torque mechanism B employed in the fall board structure of the present embodiment. In other words, FIG. 7 is a sectional view taken on line VII—VII in FIG. 2.

The side arm 2 is equipped with the aforementioned torque shaft unit 17. A second bottom surface 2*c* and a hole 2*e* are formed on the recess 2*a* of the side arm 2. They are formed in shapes to roughly engage with the torque shaft unit 17. An attachment portion 17*d* of the torque shaft unit 17 is fixed on the second bottom surface 2*c* of the recess 2*a* of the side arm 2 by screws 18 and 19. In addition, an outer cylinder portion 17*c* of the torque shaft unit 17 loosely engages with interior space of the hole 2*e* of the recess 2*a* of the side arm 2.

The torque shaft unit 17 is formed as the known torque shaft bush and is constructed by a torque shaft 17*a* made of metal and a friction member 17*b* made of rubber as well as the outer cylinder portion 17*c* and the attachment portion 17*d*, both of which are made of resin material, for example. Herein, the friction member 17*b* engages with outer periphery of the torque shaft 17*a*. In addition, the outer cylinder portion 17*c* engages with outer periphery of the friction member 17*b*. Due to frictional force of the friction member 17*b*, the torque shaft unit 17 produces resistance force, which is approximately constant, in response to bidirectional rotation of the torque shaft 17*a* which is effected with respect to the outer cylinder 17*c*.

The rotation member 20 is assembled to the torque shaft unit 17. The rotation member 20 is constructed by a "circular" clutch portion 20*a* and a lever portion 20*b*.

A "cylindrically shaped" extending portion 20*c* is formed from a base end of the lever portion 20*b* as an integral part of the rotation member 20. A tip end of the extending portion 20*c* is brought into contact with the outer cylinder portion 17*c* of the torque shaft unit 17. In addition, the torque shaft end 17*a*' of the torque shaft 17*a* is loosely inserted into interior space of the extending portion 20*c* and is placed in engagement with the clutch portion 20*a*.

The clutch portion 20*a* of the rotation member 20 is equipped with the one-way clutch mechanism. That is, the clutch portion 20*a* locks the shaft, engaging therewith, with respect to one direction of rotation of the shaft, while it release the lock to release the shaft with respect to another direction of rotation of the shaft.

Figure 8:
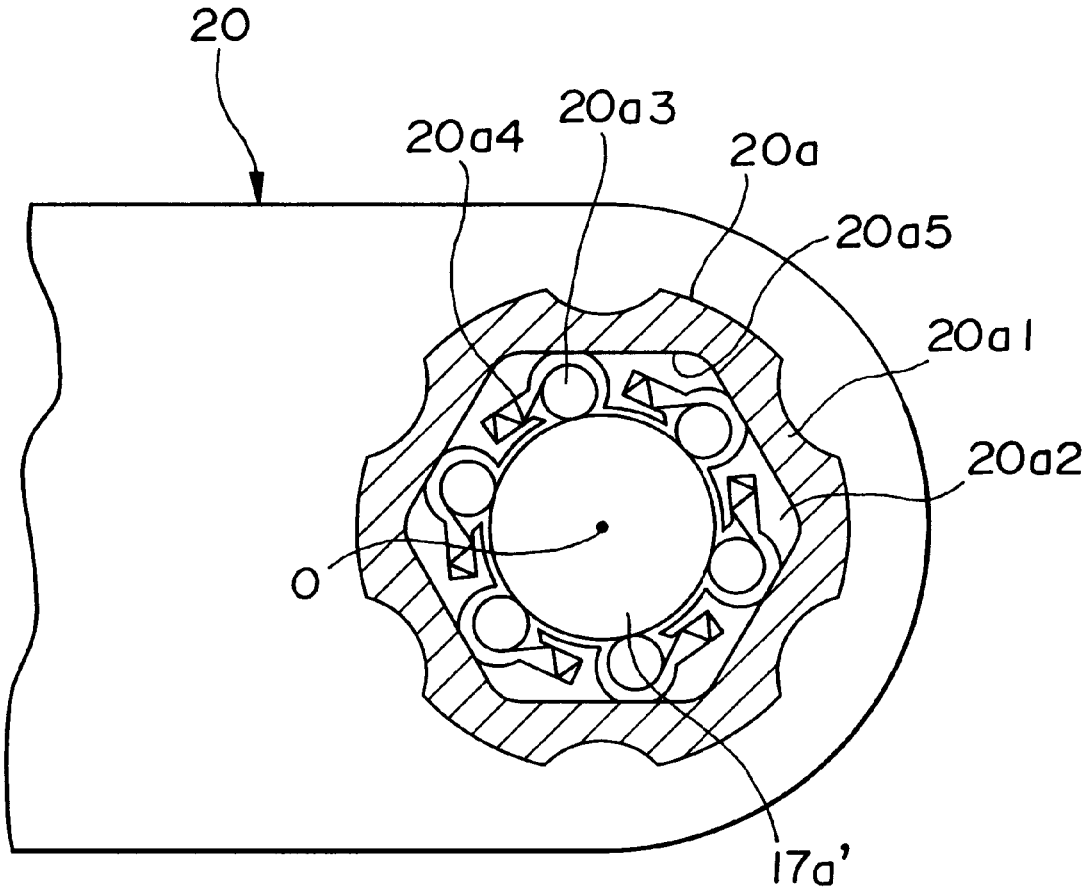
FIG. 8 is a sectional view, taken on line VIII-VIII in FIG. 7, showing a construction of a selected part of a rotation member which is a part of the open/close mechanism of the fall board structure.

FIG. 8 shows a construction of a selected part of the rotation member 20, in other words, FIG. 8 is a sectional view taken on line VIII—VIII in FIG. 7.

The clutch portion 20*a* of the rotation member 20 is constructed such that six hold members 20*a*2 are arranged along inner periphery of an outer ring metal fitting 20*a*1. In addition, each of six needle rollers 20*a*3 is inserted between two hold members 20*a*2 which are placed adjacent to each other. Herein, the needle roller 20*a*3 is loosely inserted between the hold members 20*a*2 such that it is not detached from the hold members 20*a*2. Each of the needle rollers 20*a*3 is normally pressed in a counterclockwise direction in FIG. 8 by each of plate springs 20*a*4. The inner periphery 20*a*5 of the outer ring metal fitting 20*a*1 is shaped approximately in hexagon. Herein, the center of each of six sides of the hexagon is placed closest to a rotation center "O". Each of the needle rollers 20*a*3 is shifted in position from the center of each side of the hexagon slightly in the counterclockwise direction.

Now, suppose an even that the rotation member 20 rotates about the torque shaft end 17*a*' of the torque shaft unit 17 in the counterclockwise direction in FIG. 8. In that event, each of the needle rollers 20*a*3 moves against the clutch portion 20*a* in a clockwise direction, so that it is pressed in an inner direction. Thus, the torque shaft end 17*a*' is strongly locked. Therefore, the torque shaft 17*a* of the torque shaft unit 17 rotates together with the rotation member 20. In contrast, in an event that the rotation member 20 rotates in the clockwise direction, each of the needle rollers 20*a*3 moves against the clutch portion 20*a* in the counterclockwise direction, so that it is pressed in an outer direction. Thus, the torque shaft end 17*a*' is released. Therefore, the rotation member 20 idles, while the torque shaft 17*a* of the torque shaft unit 17 does not rotate. As described heretofore, it is possible to make the open/close operations of the fall board 6 light.

In the close operation process of the fall board 6, one end 20*b*' of the lever portion 20*b* of the rotation member 20 comes in contact with a lower edge portion 8*b* of the arm 8 as shown in FIG. 2, so that it is possible to provide the shaft unit 14 with resistance force, which is transmitted to the arm 8. Because one end 20*b*' of the lever portion 20*b* is shaped in arc, it is normally placed in "smooth" contact with the lower edge portion 8*b* of the arm 8.

The aforementioned spring 22 winds about outer periphery of the extending portion 20*c* of the rotation member 20. A second end 22*b* of the spring 22 penetrates through a spring stopper portion 21 (see FIG. 7), which is provided on the lever portion 20*b* of the rotation member 20 in proximity to the side arm 2. Thus, it is terminated by the spring stopper portion 21. In addition, the first end 22*a* of the spring 22 is normally placed in contact with the neck portion 16*b* of the stopper screw 16 (see FIG. 6), so that if terminated by the stopper screw 16. Due to termination made by the-ne portion 16*b* of the stopper screw 16 and the spring topper portion 21, the spring 22 normally presses the rotation member 20 in a clockwise direction in FIG. 2. In other words, the spring 22 normally presses the rotation member 20 such that the ends 22*a* and 22*b* thereof are pressed closer to each other.

The rotation member 20 is arranged in such a way that in an arrangement direction of the keys (or lateral direction of the keyboard), an overall width portion of the arm 8 is brought into contact with the rotation member 20. The rotation member 20 regulates a rotation position (or initial position) of the fall board approximately in the full open mode because as described before, the lever portion 20*b* of the rotation member 20 is brought into contact with the head portion 16*a* of the stopper screw 16. Concretely speaking, in a first range that an opening degree measured from a full-close position of the fall board 6 is approximately greater than 75° (see FIG. 3), the position of the stopper screw 16 is set such that the rotation member 20 is located at an initial position shown in FIG. 2. In a secondly range that the opening degree measured from the full-close position of the fall board 6 is approximately less than 75°, due to pressing force applied from the spring 22, the rotation member 20 is normally placed in contact with the arm 8.

Incidentally, it is possible to use components sold on the market as the torque shaft unit 17 and the rotation member 20 respectively. realize comfortable close operation of the fall board 6, it is preferable to set resistance force of the torque shaft unit 17 strong and within a range that the fall board 6 can be closed by its own weight.

Figure 9:
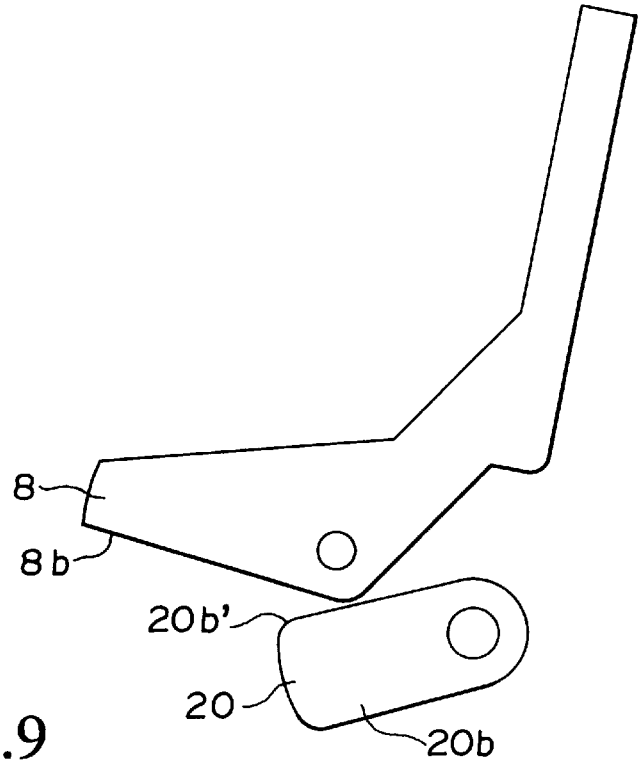
FIG. 9 is a side view showing a positional relationship between an arm and a rotation member at a full open state of the fall board.
Figure 10:
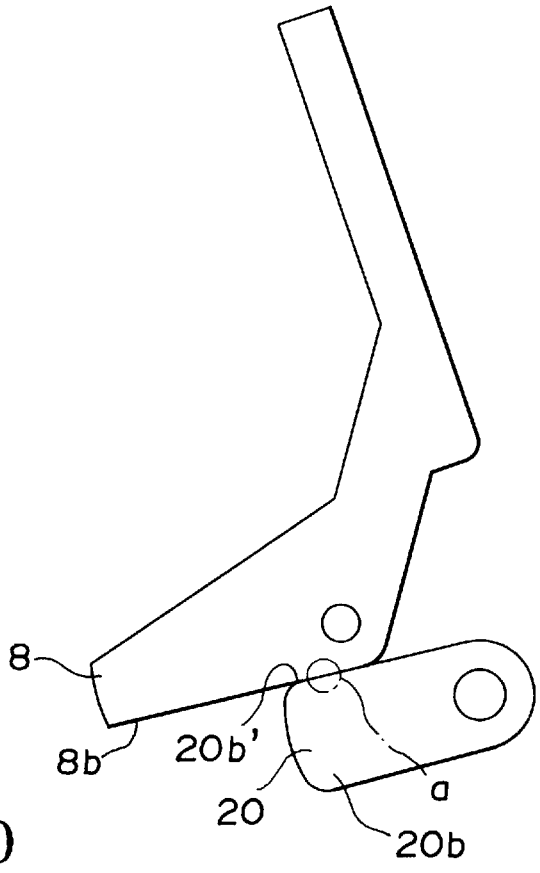
FIG. 10 is a side view showing a positional relationship between the arm and rotation member at 75° opening state changed from a full close state of the fall board.
Figure 11:
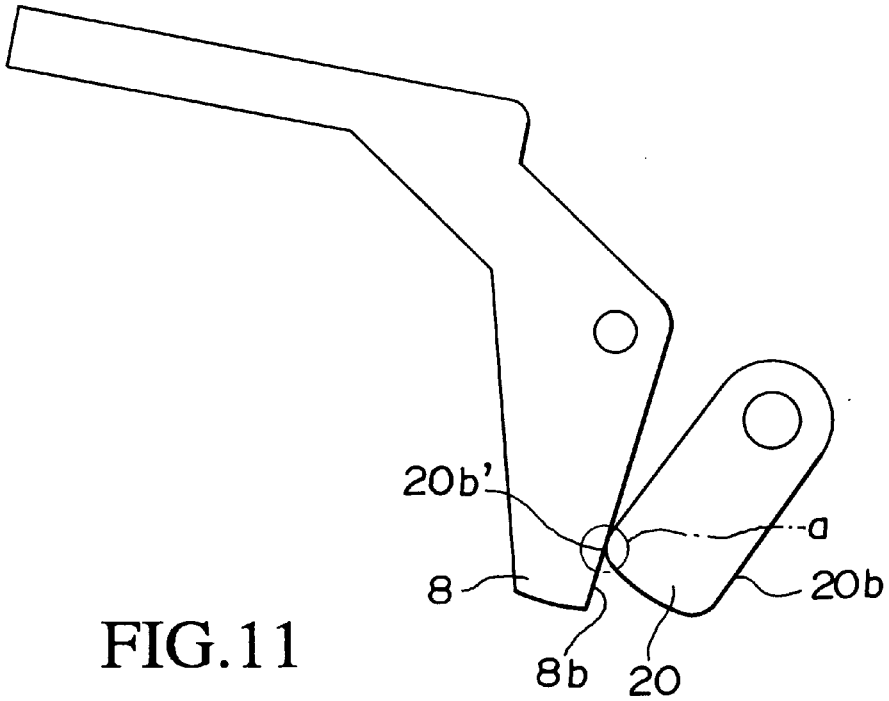
FIG. 11 is a side view showing a positional relationship between the arm and rotation member at 15° opening state changed from the full close state of the fall board.
Figure 12:
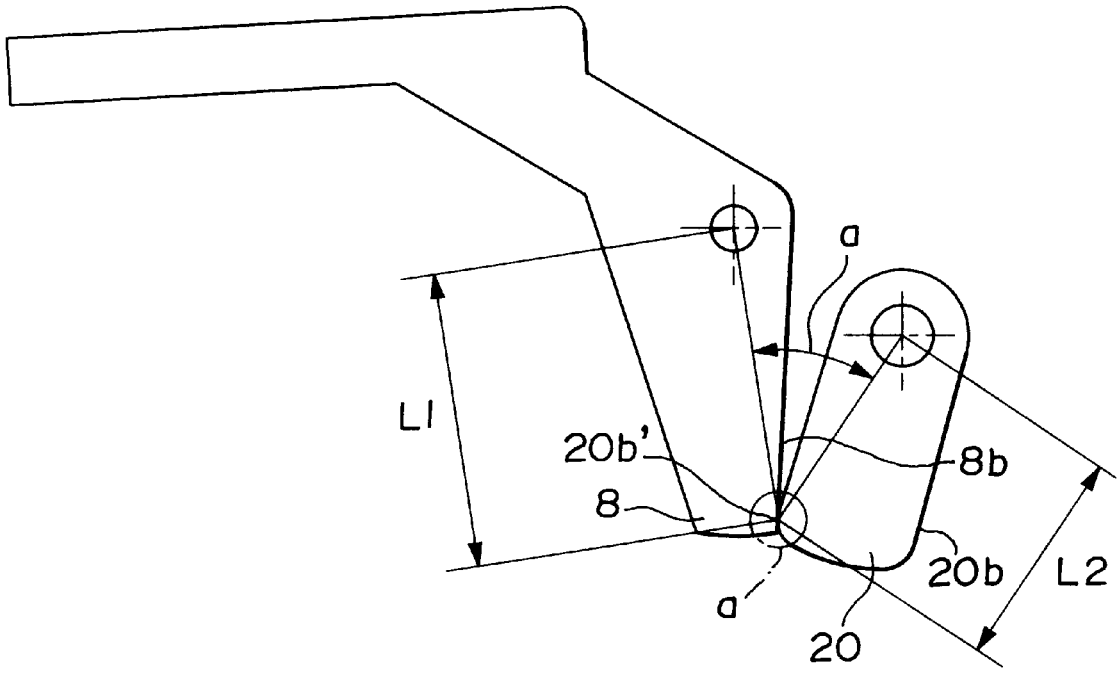
FIG. 12 is a side view showing a positional relationship between the arm and rotation member at the full close state of the fall board.

Next, a description will be given with respect to open/close operations of the fall board 6 with reference to FIG. 9 to FIG. 12, each of which shows a positional relationship between the arm 8 and the rotation member 20 under a given condition. Specifically, FIG. 9 shows a full open state of the fall board 6; FIG. 10 shows 75° opening state that the opening degree from the full-close position of the fall board 6 is approximately 75°; FIG. 11 shows 15° opening state that the opening degree is approximately 15°; and FIG. 12 shows a full close state of the fall board 6.

Under the full open state of the fall board 6 shown in FIG. 9, the arm 8 is not brought into contact with the rotation member 20. At the 75° opening state shown in FIG. 10, the arm 8 is brought into contact with the rotation member 20 at the contact point "a". Therefore, at an initial stage of the close operation process of the fall board 6, the fall board 6 is placed in a "play" state where the fall board 6 has a play in operation. Thus, it is possible to rotate the fall board 6 in a close operation direction with small force.

If the fall board 6 is further rotated in the close operation direction from the state of FIG. 10, close operation force is transmitted from the arm 8 to the rotation member 20 via the contact (i.e., contact point "a") between one end 20*b*' of the lever portion 20*b* of the rotation member 20 and the lower edge portion 8*b* of the arm 8, so that the rotation member 20 rotates in a counterclockwise direction (see FIG. 11). In such a case, as described before, the clutch portion 20*a* of the rotation member 20 locks the shaft end 17*a*' of the torque shaft 17*a* of the torque shaft unit 17. Thus, the torque shaft 17*a* rotates so that the torque shaft unit 17 produces resistance force. The resistance force is transmitted from the lever portion 20*b* of the rotation member 20 to the arm 8 via the contact point "a". Thus, it is possible to impart the resistance force to the fall board 6 with respect to its close operation.

If the fall board 6 is rotated still further in the close operation direction, the fall board 6 is placed in the full close state (see FIG. 12) through the state of FIG. 11 under influence of the resistance force which is transmitted from the arm 8 to the fall board 6 via the contact between the lower edge portion 8*b* of the arm 8 and one end 20*b*' of the rotation member 20.

In the close operation process of the fall board 6, resistance force applied to the arm 8 is gradually increased from an initial stage shown in FIG. 10 to a last stage shown in FIG. 12. Because, the positional relationship between the arm 8 and the rotation member 20 is set in such a way that as the fall board 6 moves deeply in the close operation direction, an increase ratio, which is calculated for a rotation angle of the rotation member 20 against a rotation angle of the arm 8, becomes gradually large. Such setting can be actualized by approximately setting the position of the arm rotation shaft 14*a* of the shaft unit 14, position of the torque shaft 17*a* of the torque shaft unit 17 and contact position between the arm 8 and the rotation member 20 respectively.

The embodiment 1 described above is designed such that in response to the close operation process of the fall board 6 that the opening degree of the fall board 6 measured from the full close position is degreased by every 15° from 75° to 0°, the rotation angle of the rotation member 20 is set at 6°, 9°, 12.5°, 15° and 21° respectively, for example. Just before the full close state of the fall board 6, the rotation angle of the rotation member 20 becomes maximal. As compared with a rotation angle of 15° of the arm 8 which is measured between the state of FIG. 11 and the state of FIG. 12, the rotation angle of the rotation member 20 is set at 21°, for example. Incidentally, it is possible to freely set the increase ratio of the rotation angle of the rotation member 20 against the rotation angle of the arm 8. Namely, as the fall board rotates deeply in a close operation direction thereof from an open state thereof, an increase ratio of a rotation angle of a torque shaft unit or a rotation member at a predetermined rotation angle of the fall board is increased in an arithmetical series manner (using common differences) approximately in an overall rotation range of the fall board.

The torque shaft unit 17 produces the resistance force due to the frictional resistance of the friction member 17. The resistance force effected on rotation of the torque shaft 17*a* in its practical range becomes large in response to rotation speed of the torque shaft 17*a*. Because of the aforementioned setting, as the fall board 6 rotates deeply in the close operation direction, the resistance force transmitted to the arm 8 becomes large. Thus, the user has a feeling in operation of the fall board 6 such that as the rotation angle of the arm 8 becomes large as compared with the rotation angle of the rotation member 20, it becomes difficult to speedily close the fall board 6. That is, the user feels that the fall board 6 is somewhat "heavy". According to the present embodiment, the fall board 6 rotates in the close operation direction with "light" force at the initial stage of the normal close operation process, while just before the full close state, the fall board 6 slowly closes.

Incidentally, the present embodiment lists the aforementioned increase ratio of the rotation angle of the rotation member 20 against the rotation angle of the arm as the parameter which regards "weight" in close operation of the fall board. Analytically speaking, there exist a variety of parameters other than the aforementioned increase ratio. For example, it is possible to list other parameters as follows:

Characteristic of the frictional resistance of the torque shaft unit 17, in other words, proportional relationship between the frictional resistance and speed;

Distance L1 measured between the contact point "a" and the arm rotation shaft 14*a* of the shaft unit 14 (see FIG. 12);

Distance L2 measured between the contact point "a" and the torque shaft 17*a* of the torque shaft unit 17 (see FIG. 12); and Interior angle R formed among the arm rotation shaft 14*a*, contact point "a" and torque shaft 17*a*.

In order to provide the fall board with "heavy" feeling as the close operation of the fall board progresses deeply, if it is assumed that the fall board is closed with a constant speed, it is necessary to set the fall board structure such that rotation moment applied to the arm 8 becomes gradually large in response to progress of the close operation of the fail board. The above is realized by appropriate combination of the aforementioned parameters. In order to do so, it is necessary to control parameters as follows:

(a) Gradually increase the distance L1;

(b) Gradually decrease the distance L2; or (c) Gradually increase the interior angle R within a range of 90°.

So, in consideration of the characteristic of the frictional resistance of the torque shaft unit 17, it is necessary to set appropriate combination of the aforementioned controls (a) to (c).

Constituent elements contributing to the open operation mode of the fall board 6 are reversed in processes as compared with the close operation mode of the fall board 6 described above.

At the open operation mode of the fall board 6, the arm 8 rotates in the clockwise direction in FIG. 9 to FIG. 12. Because the rotation member 20 is not rotated by the arm 8 in the open operation mode of the fall board 6, the fall board 6 is not placed under effect of the resistance force of the torque shaft unit 17. Therefore, it is possible to perform the open operation of the fall board 6 lightly. In addition, it is described before that at the open operation mode, the clutch portion 20*a* of the rotation member 20 releases the lock of the torque shaft end 17*a*' of the torque shaft unit 17 with respect to its rotation in the clockwise direction. For this reason, the torque shaft unit 17 does not produce torque resistance. So, being accompanied with rotation of the arm 8, the rotation member 20 rotates in the clockwise direction due to only the "weak" pressing force applied thereto from the spring 22. Thus, it is possible to easily actualize the contact established between the rotation member 20 and the lower edge portion 8*b* of the arm 8 with a simple construction. In response to the rotation of the rotation member 20 in the close operation direction of the fall board 6, the torque shaft unit 17 immediately produces resistance force. So, if the user switches over his or her operation of the fall board 6 the close operation in the middle of the open operation process, occurrences of "play" can be almost avoided, so that it is possible to immediately obtain the resistance force to respond to the close operation of the fall board 6.

As described heretofore, the embodiment 1 is designed to gradually increase the increase ratio of the rotation angle of the rotation member 20 against the rotation angle of the arm 8 in the close operation direction of the fall board 6. Therefore, at the initial stage of the close operation process of the fall board 6, the fall board 6 can be rotated speedily with light force, so it is possible to perform the close operation of the fall board 6 comfortably. In contrast, just before the full close state, the fall board 6 becomes most heavy in close operation, so the fall board 6 closes slowly. Thus, it is possible to avoid a risk that a hand (or hands) of the user is strongly sandwiched between the base rod portion 25 and the fall board front 6*a*.

In a range that the opening degree of the fall board 6, measured from its full-close position, ranges from 0° to approximately 75°, the present embodiment maintains the contact established between the arm 8 and the rotation member 20 due to the spring 22 in the open operation process of the fall board 6. Therefore, when the user proceeds to the close operation in the middle of the open operation process of the fall board 6, it is possible to immediately obtain resistance force for the close operation of the fall board 6. Thus, the present embodiment has good follow-up performance and good response as well as safety in operations of the fall board 6. Particularly, when the user releases the fall board front 6*a* just after the user slightly lifts up the fall board front 6*a* from its full-close position, there is no risk that the hand (or hands) of the user is strongly sandwiched between the base rod portion 25 and the fall board front 6*a*. Further, the present embodiment provides the clutch portion 20*a* of the rotation member 20 with the one-way clutch mechanism, by which the torque shaft unit 17 produces resistance force with respect to only the close operation direction of the fall board 6. Thus, it is possible to maintain engagement between the arm 8 and the rotation member 20 with ease and with a simple construction such as the spring 22.

Furthermore, the present embodiment is capable of making the resistance force variable in response to an angle to close the fall board 6 by means of a single torque shaft unit 17, which is simple in construction. Moreover, the present embodiment is capable of freely setting a manner to impart the resistance force to the arm 8 by the approximate setting made for the position of the arm rotation shaft 14*a* of the shaft unit 14, position of the torque shaft 17*a* of the torque shaft unit 17 and contact position between the arm 8 and rotation member 20. So, it is possible to make the optimum setting without complicating construction of the fall board structure. At the open operation mode of the fall board 6, the rotation member 20 is not rotated by the arm 8, so the resistance force is not imparted to the arm 8. Thus, it is possible to perform the open operation of the fall board 6 with light force, in other words, it is possible to make the open operation of the fall board 6 smooth.

As a result, it is possible to actualize a safe and comfortable way in open/close operations of the fall board with a simple fall board structure.

In the embodiment 1 described heretofore, the rotation mechanism A and the torque mechanism B are separated from each other and constructed independently of each other. Even if load such as excessive weight and impact is applied to the fall board 6, the torque mechanism B is not influenced by such load so much. Therefore, it is possible to protect the torque mechanism B from damages and failures. In some case, the arm rotation shaft 14*a* and similar components are strengthened to secure sufficient strength against the load applied to the fall board 6. In such a case, the torque mechanism B is not influenced by the load so much, so the present embodiment has a certain degree of freedom in design. In the case of the failure of the rotation mechanism A, the present embodiment can be easily repaired by merely replacing the rotation mechanism A with a new one. So, the present embodiment is superior in maintenance and is capable of reducing cost for the repair. As compared with the rotation mechanism A, the torque mechanism B itself is hardly damaged. Therefore, the aforementioned effects bring great advantage.

[B] Embodiment 2

Figure 13A:
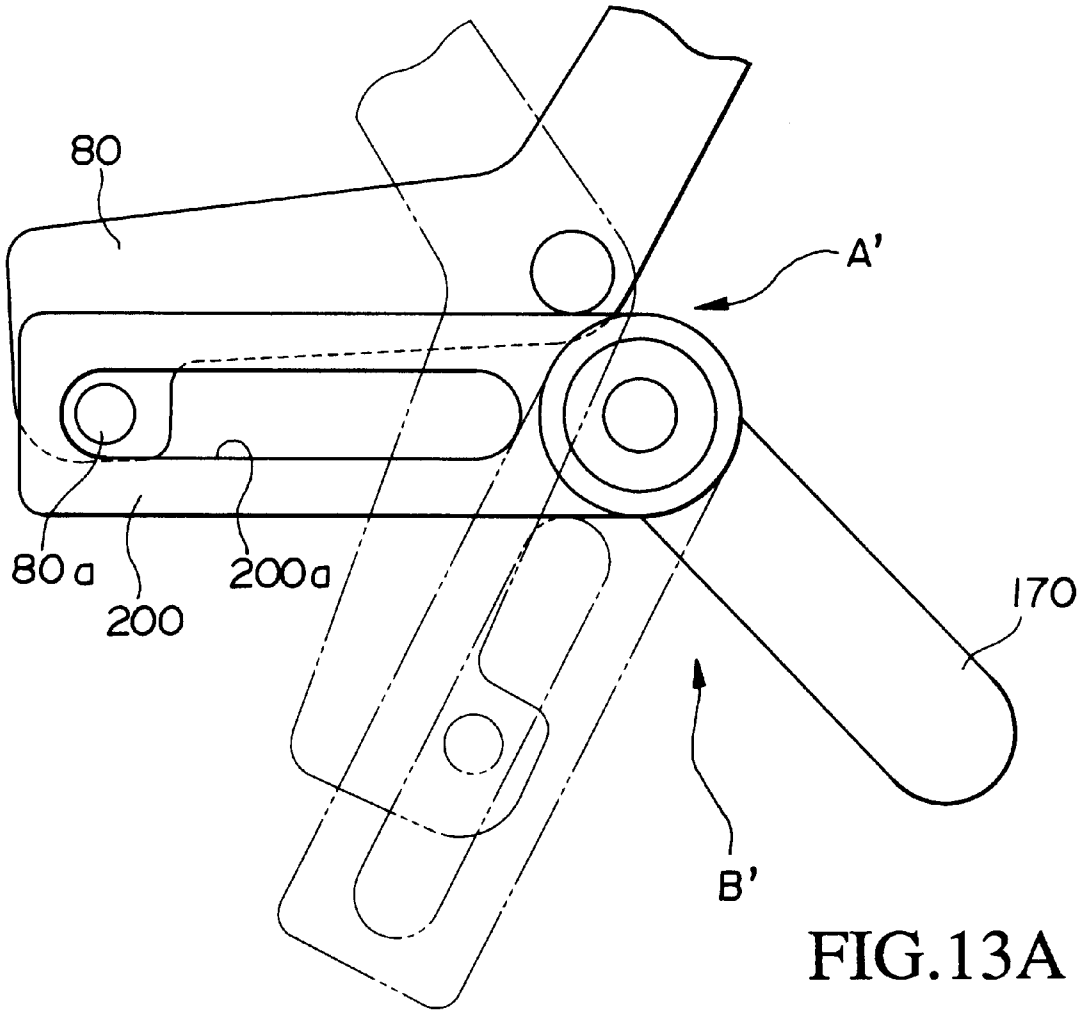
FIG. 13A is a front view showing constructions of a rotation mechanism and a torque mechanism for an arm of a fall board structure in accordance with embodiment 2 of the invention.
Figure 13B:
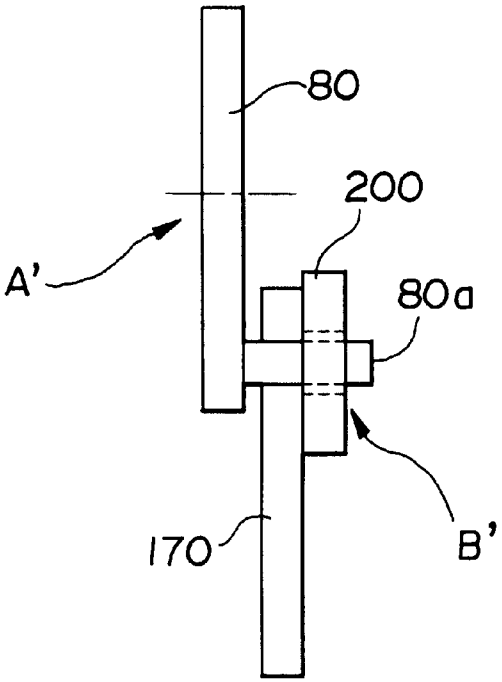
FIG. 13B is a side view showing the constructions of the rotation mechanism and torque mechanism.

FIG. 13A and FIG. 13B diagrammatically show constructions of a rotation mechanism A' and a torque mechanism B' for an arm of a fall board structure of a keyboard instrument in accordance with embodiment 2 of the invention. Specifically, FIG. 13A is a front view showing the mechanisms while FIG. 13B is a side view showing the mechanims.

In FIG. 13A and FIG. 13B, a torque shaft unit 170 of the embodiment 2 is constructed similar to the foregoing torque shaft unit 17 of the embodiment 1. In addition, a construction of engagement between the torque shaft unit 170 and a rotation member 200 of the embodiment 2 is constructed similar to the foregoing construction of engagement between the torque shaft unit 17 and rotation member 20 of the, embodiment 1 as well. That is, only when the rotation member 200 rotates in a counterclockwise direction in FIG. 13A, the torque shaft unit 170 produces resistance force. Incidentally, an elongated hole 200*a* is formed on the rotation member 200.

An engagement projection 80*a* projects from one end of the arm 80. The engagement projection 80*a* of the arm 80 is loosely inserted into the elongated hole 200*a* of the rotation member 200 in such a way that it can move in an elongated direction of the elongated hole 200*a*.

There are provided parameters such as rotation center of the arm 80, rotation center of the rotation member 200, position of the engagement projection 80*a* and position of the elongated hole 200*a*. Those parameters are set such as to gradually increase an increase ratio of a rotation angle of the rotation member 200 against a rotation angle of the arm 80 as the arm 80 moves deeply in the close operation direction of the fall board. Constructions of other parts of the embodiment 2 are identical to those of the aforementioned embodiment 1.

In the embodiment 2 whose construction is described above, when the arm 80 rotates in the close operation direction of the fall board, the engagement projection 80*a* forces the rotation member 200 to rotate in the counterclockwise direction by means of the elongated hole 200*a* while it moves toward the rotation center of the rotation member 200 along the elongated hole 200*a*. Thus, as similar to the aforementioned embodiment 1, resistance force is applied to the arm 80 in the embodiment 2. In addition, the resistance force that works to resist close-operation force of the board becomes gradually large in response to progress of the close operation process of the fall board. In the embodiment 2, the rotation member 200 is also rotated by the arm 80 at the open operation mode as well as the close operation mode of the fall board, however, rotation direction at the open operation mode is reverse to rotation direction at the close operation mode. For this reason, due to existence of the one-way clutch mechanism, it is possible to provide the rotation member 200 with the open operation of a light and comfortable manner.

As described heretofore, the embodiment 2 is capable of demonstrating the same Its of the embodiment 1 as well.

[C] Modifications (1) The embodiment 2 of the invention is designed have the simple setting that as the arm 80 moves deeply in the close operation direction of the fall board, the increase ratio of the rotation angle of the rotation member 200 against the rotation angle of the arm 80 is gradually increased. Therefore, it is possible to think out other constructions (or modifications) to actualize the above setting. For example, it is possible to reverse the engagement relationship, employed by the embodiment 2, between the arm 80 and the rotation member 200. That is, the engagement projection 80 is attached to the rotation member 200 while the elongated hole 200*a* is formed on the arm 80. In such a modification, the setting is approximately made to optimize the positional relationship between the rotation shafts.

(2) The embodiment 1 employs a construction that the rotation member 20 is brought into contact with the arm 8. However, the present invention is not limited in such a construction. In the bottom line, the fall board structure of the present embodiment should employ the construction that mutual engagement relationship between the arm and rotation member is secured. Therefore, the embodiment 1 can be modified to employ the positional relationship between the engagement projection 80*a* and the elongated hole 200*a* of the embodiment 2.

(3) The embodiments 1 and 2 can be modified to reverse the positional relationship between the torque shaft unit 17 (170) and the rotation member 20 (200). That is, the rotation member 20 is fixed to the side arm 2, while the torque shaft unit 17 is redesigned to have a capability of freely rotating with respect to the rotation member 20, so that one end of the torque shaft unit 17 is placed in contact and engagement with the arm 8.

(4) The embodiments 1 and 2 use combination of the torque shaft unit 17 and the rotation member 20 as the torque mechanism B. However, the present invention is not limited to employ such a combination. In the bottom line, the present embodiment uses the one-way clutch mechanism, so the torque mechanism B can be constructed using only the torque shaft unit 17. For example, the torque shaft unit 17 can be redesigned such that the torque shaft end 17*a*' is fixed to the side arm 2 while an extending portion like the lever portion 20*b* is provided for the outer cylinder portion 17*c* and is brought into contact with the arm 8.

(5) Roughly speaking, the fall board rotates about a rotation shaft (e.g., 14*a*) fixed to a main body of the keyboard instrument, so that the fall board can be opened or closed. Such a construction can be modified such that the fall board rotates about a rotation axis portion provided in connection with the main body of the keyboard instrument. For example, holes are formed at both of side ends of the main body of the keyboard instrument while projections or shafts project from interior walls of both of side ends of the fall board, wherein the shafts engage with the holes to form rotation axis portions, about which the fall board rotates.

(6) As the fall board rotates deeply in a close operation direction thereof from an open state thereof, an increase ratio of a rotation angle of the torque shaft unit or rotation member against a rotation angle of the fall board is increased in an arithmetical series manner (using common differences) approximately in an overall rotation range of the fall board except a full-close-related rotation range of the fall board just before its full close state. In the full-close-related rotation range of the fall board, the increase ratio is set greater than the common difference of the arithmetical series manner.

(7) The friction member (17*b*) made of rubber produces frictional force (or resistance force), which is increased in proportion to rotation speed of the rotation member (20) or torque shaft (17*a*). Therefore, like the above, as the fall board proceeds from the open state to the close state up to the full-close-related rotation range of the fall board just before its full close state, the frictional force is increased in an arithmetical series manner. In the full-close-related rotation range of the fall board, the frictional force is controlled to be greater than the common difference of the arithmetical series manner.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A fall board structure of a keyboard instrument comprising:

a fall board which rotates about a rotation axis portion provided in connection with a main body of the keyboard instrument, so that the fall board can be opened or closed;

a torque shaft unit, having a shaft portion having a capability of free rotation, which produces resistance force against rotation of the shaft portion; and a rotation member being engaged with the shaft portion of the torque shaft unit, the rotation member having a capability to lock the shaft portion with respect to the torque shaft unit, wherein one of the torque shaft unit and the rotation member is fixed to the main body of the keyboard instrument while another one of the torque shaft unit and the rotation member engages with the fall board which is placed in a close operation process to rotate about the shaft portion of the torque shaft unit so that the torque shaft unit produces resistance force, which is transmitted to the fall board, and wherein as the fall board rotates deeply in a close operation direction thereof, an increase ratio of a rotation angle of said another one of the torque shaft unit and the rotation member against a rotation angle of the fall board is increased larger.

2. A fall board structure of the keyboard instrument according to claim 1 further comprising an engagement maintaining mechanism which maintains engagement between the fall board and said another one of the torque shaft unit and the rotation member in an open operation process of the fall board.

3. A fall board structure of the keyboard instrument according to claim 1, wherein the rotation member is equipped with a one-way clutch mechanism that locks the shaft portion of the torque shaft unit with respect to rotation of the rotation member corresponding to the close operation direction of the fall board while releasing the shaft portion of the torque shaft unit with respect to rotation of the rotation member corresponding to an open operation direction of the fall board.

4. A fall board structure of the keyboard instrument according to claim 2, wherein the rotation member is equipped with a one-way clutch mechanism that locks the shaft portion of the torque shaft unit with respect to rotation of the rotation member corresponding to the close operation direction of the fall board while releasing the shaft portion of the torque shaft unit with respect to rotation of the rotation member corresponding to an open operation direction of the fall board.

5. A fall board structure of a keyboard instrument comprising.

a fall board which rotates about a rotation axis portion provided in connection with a main body of the keyboard instrument, so that the fall board can be opened or closed;

a torque shaft unit, having a shaft portion having a capability of free rotation, which produces resistance force against rotation of the shaft portion; and a rotation member being engaged with the shaft portion of the torque shaft unit, the rotation member having a capability to lock the shaft portion with respect to the torque shaft unit, wherein one of the torque shaft unit and the rotation member is fixed to the main body of the keyboard instrument while another one of the torque shaft unit and the rotation member engages with the fall board which is placed in a close operation process to rotate about the shaft portion of the torque shaft unit so that the torque shaft unit produces resistance force, which is transmitted to the fall board, and wherein as the fall board rotates deeply in a close operation direction thereof from an open state thereof, an increase ratio of a rotation angle of said another one of the torque shaft unit and the rotation member at a predetermined rotation angle of the fall board is increased in an arithmetical series manner approximately in an overall rotation range of the fall board.

6. A fall board structure of a keyboard instrument comprising:

a fall board which rotates about a rotation axis portion provided in connection with a main body of the keyboard instrument, so that the fall board can be opened or closed;

a torque shaft unit, having a shaft portion having a capability of free rotation, which produces resistance force against rotation of the shaft portion; and a rotation member being engaged with the shaft portion of the torque shaft unit, the rotation member having a capability to lock the shaft portion with respect to the torque shaft unit, wherein one of the torque shaft unit and the rotation member is fixed to the main body of the keyboard instrument while another one of the torque shaft unit and the rotation member engages with the fall board which is placed in a close operation process to rotate about the shaft portion of the torque shaft unit so that the torque shaft unit produces resistance force, which is transmitted to the fall board, and wherein as the fall board rotates deeply in a close operation direction thereof, an increase ratio of a rotation angle of said another one of the torque shaft unit and the rotation member against a rotation angle of the fall board is increased larger, while as the fall board rotates deeply in the close operation direction thereof from an open state thereof, an increase ratio of a rotation angle of the rotation member at a predetermined rotation angle of the fall board just before a full close state is increased as compared with an increase ratio of the rotation angle of the rotation member at a previous rotation angle of the fall board.

7. A fall board structure of a keyboard instrument comprising:

a fall board which rotates about a rotation axis portion provided in connection with a main body of the keyboard instrument, so that the fall board can be opened or closed;

a torque shaft unit, having a shaft portion having a capability of free rotation, which produces resistance force against rotation of the shaft portion; and a rotation member being engaged with the shaft portion of the torque shaft unit, the rotation member having a capability to lock the shaft portion with respect to the torque shaft unit, wherein one of the torque shaft unit and the rotation member is fixed to the main body of the keyboard instrument while another one of the torque shaft unit and the rotation member engages with the fall board which is placed in a close operation process to rotate about the shaft portion of the torque shaft unit so that the torque shaft unit produces resistance force, which is transmitted to the fall board, and wherein as the fall board rotates deeply in a close operation direction thereof from an open state thereof, an increase ratio of a rotation angle of said another one of the torque shaft unit and the rotation member at a predetermined rotation angle of the fall board is increased in an arithmetical series manner approximately in an overall rotation range of the fall board, except a full-close-related rotation range of the fall board just before its full close state, while said increase ratio is set greater than a common difference of the arithmetical series manner in said full-close range of the fall board.

8. A fall board open/close control method comprising the steps of:

setting a fall board to have a capability of free rotation in connection with a main body of a keyboard instrument;

activating a friction member, provided between the fall board and the main body of the keyboard instrument, to produce frictional force in response to rotation of the fall board; and controlling the frictional force to be increased in an arithmetical series manner in a process that the fall board proceeds from an open state to a close state up to a position of the fall board just before its full close state.

9. A fall board open/close control method comprising the steps of:

setting a fall board to have a capability of free rotation in connection with a main body of a keyboard instrument;

activating a friction member, provided between the fall board and the main body of the keyboard instrument, to produce frictional force in response to rotation of the fall board;

controlling the frictional force to be increased in an arithmetical series manner in a process that the fall board proceeds from an open state to a close state up to a full-close-related rotation range of the fall board just before its full close state; and further controlling the frictional force to be greater than a common difference of the arithmetical series manner in the full-close-related rotation range of the fall board.

10. A fall board structure of a keyboard instrument having a keyboard in which a plurality of keys are arranged between side arms, said fall board structure comprising:

a fall board which covers the keys of the keyboard;

an arm fixed to a side end of the fall board, so that the arm rotates in response to rotary movement of the fall board;

a torque shaft unit, fixed to the side arm of the keyboard, which produces resistance force, the torque shaft unit having a shaft portion which rotates in accordance with the rotary movement of the fall board;

a rotation member being constructed by a clutch portion and a lever portion, wherein the shaft portion of the torque shaft unit engages with the clutch portion of the rotation member equipped with a one-way clutch mechanism such that the clutch portion locks the shaft portion when the shaft portion rotates in a counter-clockwise direction corresponding to a close operation direction of the fall board while the clutch portion releases the shaft portion when the shaft portion rotates in a clockwise direction corresponding to an open operation direction of the fall board; and a pressing mechanism which normally presses the rotation member in the clockwise direction, wherein a lower edge portion of the arm is brought into contact with the lever portion of the rotation member at a contact point so that the resistance force produced by the torque shaft unit is transmitted to the arm via the contact point when the fall board is operated to be closed in the close operation direction.

11. A fall board structure of the keyboard instrument according to claim 10, wherein as the fall board rotates deeply in the close operation direction, an increase ratio of a rotation angle of the rotation member against a rotation angle of the arm is increased larger so that the resistance force transmitted to the arm becomes larger.

12. A fall board structure of the keyboard instrument according to claim 10 further comprising an arm rotation mechanism which allows the arm to freely rotate in both of the close operation direction and the open operation direction.

13. A fall board structure of a keyboard instrument having a keyboard in which a plurality of keys are arranged between side arms, said fall board structure comprising:

a fall board which covers the keys of the keyboard;

an arm fixed to a side end of the fall board, so that the arm rotates in response to rotary movement of the fall board;

a torque producing mechanism having a shaft portion, which is freely rotated and produces a resistance force;

a one-way clutch mechanism which is rotated in a close operation direction of the fall board to lock the shaft portion of the torque producing mechanism and which is rotated in an open operation direction of the fall board to release the shaft portion of the torque producing mechanism; and a rotation mechanism that rotates in response to the rotary movement of the fall board, and that engages with the torque producing mechanism to produce the resistance force, which is transmitted to the arm by means of the one-way clutch mechanism only when the fall board is operated to rotate in the close operation direction.

14. The fall board structure of claim 13, further comprising a contact member that brings the rotation member in contact with the arm in an open operation of the fall board.

* * * * *